US005314739A

United States Patent [19]

Teodoro Vidal

[11] Patent Number: 5,314,739

[45] Date of Patent: May 24, 1994

[54] SECURITY PAPER FOR BANK NOTES AND OTHER DOCUMENTS

[75] Inventor: Juan Teodoro Vidal, Burgos, Spain

[73] Assignee: Fabrica Nacional de Moneda Y Timbre, Madrid, Spain

[21] Appl. No.: 923,994

[22] PCT Filed: Jan. 10, 1992

[86] PCT No.: PCT/ES92/00005

§ 371 Date: Dec. 15, 1992

§ 102(e) Date: Dec. 15, 1992

[87] PCT Pub. No.: WO92/12293

PCT Pub. Date: Jul. 23, 1992

[30] Foreign Application Priority Data

Jan. 10, 1991 [ES] Spain ..... 9100063

[51] Int. Cl.[5] ..... B32B 3/00

[52] U.S. Cl. ..... 428/195; 428/292; 428/294; 428/375; 428/690; 428/915

[58] Field of Search ..... 428/195, 292, 294, 375, 428/704, 908, 915, 916, 690, 195, 690, 915; 106/21, 22; 162/108; 283/91, 92

[56] References Cited

U.S. PATENT DOCUMENTS

| | | | |
|---|---|---|---|
| 3,880,706 | 4/1975 | Williams | 162/103 |
| 4,652,015 | 3/1987 | Crane | 283/91 |
| 4,756,557 | 7/1988 | Kaule et al. | 283/85 |
| 4,897,300 | 1/1990 | Boehm | 428/195 |
| 5,118,349 | 6/1992 | Jalon | 106/21 |
| 5,161,829 | 11/1992 | Detrick et al. | 283/91 |

FOREIGN PATENT DOCUMENTS

| | | | |
|---|---|---|---|
| 0185396 | 6/1986 | European Pat. Off. | D21H 5/10 |
| 2117055 | 7/1972 | France | D21H 5/00 |
| 136876 | 9/1974 | United Kingdom | D21H 5/10 |

*Primary Examiner*—Patrick J. Ryan
*Assistant Examiner*—William A. Krynski
*Attorney, Agent, or Firm*—Pennie & Edmonds

[57] ABSTRACT

The security paper incorporates, as fundamental characteristic, groups of security yarns which are braided within each group, using at least three yarns so that such braiding presents a very characteristic irregular surface, easily detectable by touch, for identification of the document either by the bank staff or by blind people. The use of yarns of different colours in each braiding allows to form colour combinations which collaborate in the personalization of the yarn and, consequently of the document, for example the colours of the national flag corresponding to the country issuing the document.

2 Claims, No Drawings

SECURITY PAPER FOR BANK NOTES AND OTHER DOCUMENTS

OBJECT OF THE INVENTION

The present invention relates to the structure of a new security paper, namely as used in the manufacture of bank notes and other kinds of valuable documents, within which paper are provided yarns or markings to enhance its security in the face of various modes of or attempts at counterfeiting.

BACKGROUND OF THE INVENTION

With this aim of preventing, or at any rate impairing, the forging of a document, security paper provided inside with sheets or yarns of a suitable nature to personalize the document, and thereby enhance its security, are well-known.

More specifically, security yarns are inserted in the paper at the sheet formation stage, so that they remain in the cellulose fibres, and hence any attempt at removing the same implies either tearing the paper or breaking the yarn, which clearly reveals that the document has been tampered with.

Thus, in theory, the provision of a security yarn stands as security for the genuineness of a document.

However, the contemporaneous evolution of counterfeiting techniques has made it necessary to gradually perfect these security yarns, improving their performance, or to put it otherwise, hindering the tampering or copying thereof by counterfeiters. In this sense, yarns have been provided with microprinted texts, which texts can for instance refer to the country of issue, the face value of the document, the date of issue thereof, and so forth, which texts cannot be perceived at first glance but are easily detected using a small magnifying glass or any other suitable means, such as viewing the same against the light, under ultraviolet light and so on.

Techniques have also been developed which expedite the appearance of the yarns on the surface of the paper at regular intervals, to be detected by touch and hence identified by an expert.

Along these lines of evolution, the applicant himself holds Spanish patent of invention application number P 8902252(1), which describes security paper and a method for obtaining the same, which provides for the security yarns to be obtained from an alloy of magnetic material subject to heat treatment comprising a sudden cooling from a starting temperature ranging between 800° and 1500° C. down to a final temperature ranging between −180° and −225° C., thereby to obtain an amorphous solid, devoid of the usual metallic crystalline structure, so that the obtention of this kind of security yarns by potential counterfeiters is almost impossible.

DESCRIPTION OF THE INVENTION

The security paper subject of the invention, using security yarns in accordance with the contents of the latter paragraph, stems from a line of development contemporaneous to that of the said patent of invention 8902252, with the same basic objective but following a different route.

More specifically, the characteristics of the security paper subject hereof lie essentially in the fact that one of the security elements thereof comprises the provision of groups of three or more yarns, duly braided to attain the following features:

- A personalization of not only the paper but also the actual multiple yarns, for the latter can bear different colours thereby to display, for instance, the colours of the flag of the country issuing the document or what other kind of personalization soever is deemed appropriate.

- The obtention of a raised portion on the document, with the typical roughnness and unevenness of a braiding, almost impossible to copy using the classical systems to provide polyester-based slivers having an evidently smooth raised surface.

The tactile detection of various braided yarns is far easier than the detection of a normal or smooth security yarn, and the said detection is easy for bank staff, such feature also applying to the detection of documents by the blind, who will find it far easier with these braided yarns to detect, for instance, bank notes.

PREFERRED EMBODIMENT OF THE INVENTION

Now then, in accordance with the above description, the essential characteristics of the security paper subject hereof, using the basic construction of any conventional security paper and possibly providing any other known security means or complement, lie in the fact that the likewise classical security yarns are provided to the same, making up groups of three or more units, where the yarns are moreover braided, in order to provide an overall highly characteristic surface that is easily detectable and identifiable by touch.

These braids of yarn can be obtained using any machine capable of braiding thus, paying close attention to the fact that braiding and not twisting is the issue, for instance as commonly used in obtaining laces.

Each "braid" can be made up of yarns of different colours, in order to personalize the same, regardless of the fact that the yarn can be microprinted or lacquered with fluorescent or iridescent material so that it is easier to view under ultraviolet light or against the light.

It is thus not only possible as aforesaid to personalize the document as a whole, but the yarn itself can also be personalized, for instance and as set forth hereinbefore, bearing the colours of the national flag of the country issuing the document, which could with reference namely to Spain, comprise two red yarns and a yellow yarn, in the event that each braid were to be made up of the minimum number of yarns, viz. three.

As the yarns form a criss-cross, in accordance with the repeatedly mentioned braiding, this security element provides a surface with a very characteristic feel, easily identifiable to control to validity of the document, both by bank staff and privately whenever the sense of sight cannot be used, this being so in particular with the blind. Yarn braids with a thickness in access of 100 microns can, in accordance with the present invention, be incorporated into the paper.

Therefore, in addition to a greater optical density, as with any kind of yarn, a greater sensitivity to touch with an almost inimitable relief is obtained.

Tests to this end have shown the feasibility of inserting braids with a thickness in excess of one hundred microns in the paper, which thickness is clearly very high, without this posing any problems whatsoever when printing the document, whereas, on the other hand, this considerable thickness will determine a highly desirable tactile effect for the document.

We feel that the device has now been sufficiently described for any expert in the art to have grasped the full scope of the invention and the advantages it offers.

The materials, shape, size and layout of the elements may be altered provided that this entails no modification of the essential features of the invention.

The terms used to describe the invention herein should be taken to have a broad rather than a restrictive meaning.

I claim:

1. An improvement in security paper having opposite surfaces for bank notes and other documents embedded with security yarns that can be microprinted or have fluorescent or iridescent characteristics, the improvement wherein said yarns make up groups, of at least three in number, with the yarns in each group braided together to form a braid having a thickness in excess of one hundred microns and extending above a surface of the paper and allowing the easy detection thereof using the sense of touch.

2. Security paper for bank notes and other documents, as in claim one, wherein the different yarns making up the braid are coloured differently.

* * * * *